US005426400A

United States Patent [19]

Ho et al.

[11] Patent Number: 5,426,400

[45] Date of Patent: Jun. 20, 1995

[54] BROADBAND COPLANAR WAVEGUIDE TO SLOTLINE TRANSITION HAVING A SLOT CAVITY

[75] Inventors: Thinh Q. Ho, Anaheim; Stephen M. Hart, San Diego, both of Calif.

[73] Assignee: The United States of America as represented by the Secretary of the Navy, Washington, D.C.

[21] Appl. No.: 79,311

[22] Filed: Jun. 17, 1993

[51] Int. Cl.[6] ..... H01P 5/10

[52] U.S. Cl. ..... 333/26; 333/33

[58] Field of Search ..... 333/26, 33

[56] References Cited

U.S. PATENT DOCUMENTS

| | | | |
|---|---|---|---|
| 3,955,156 | 5/1976 | Fleming | 333/128 |
| 3,995,239 | 11/1976 | Head et al. | 333/26 X |
| 4,739,519 | 4/1988 | Findley | 455/324 |
| 4,882,553 | 11/1989 | Davis et al. | 333/26 X |
| 5,125,111 | 6/1992 | Trinh | 333/26 X |

FOREIGN PATENT DOCUMENTS

| | | | |
|---|---|---|---|
| 2451641 | 11/1980 | France . | |
| 2662308 | 11/1991 | France | 333/33 |
| 53-79356 | 7/1978 | Japan . | |
| 56-69901 | 11/1981 | Japan . | |
| 1147901 | 6/1989 | Japan . | |
| 220101 | 1/1990 | Japan . | |
| 2057196 | 3/1981 | United Kingdom | 333/26 |

OTHER PUBLICATIONS

T. Q. Ho and S. M. Hart, "A Broad-Band Coplanar Waveguide to Slotline Transition", *IEEE Microwave and Guided Wave Letters*, vol. 2, No. 10, Oct. 1992, San Diego, Calif., pp. 415–416.

*Primary Examiner*—Benny T. Lee

*Attorney, Agent, or Firm*—Harvey Fendelman; Thomas Glenn Keough; Michael A. Kagan

[57] ABSTRACT

A broadband coplanar waveguide to slotline transition for transferring radio frequency energy having a wavelength, λ, comprises: 1) a dielectric substrate having a first planar surface; an electrically conductive layer formed on the first planar surface; 2) a coplanar waveguide including: a) a center conductor defined by a section of the electrically conductive layer bordered by first and second parallel channels formed in the electrically conductive layer so as to expose the dielectric substrate; b) a first ground plane defined by a section of the electrically conductive layer bordering the first channel; and c) a second ground plane defined by a section of the electrically conductive layer bordering the second channel; 3) a slot cavity formed in the electrically conductive layer so as to expose an area of the dielectric substrate, the slot cavity coextensive with the first channel and having a periphery such that the length of a line segment intersecting two points of the periphery and a centroid of the area is approximately λ/4; and 3) a slotline defined by a third channel formed in the electrically conductive layer which is coextensive with the second channel.

21 Claims, 5 Drawing Sheets

BROADBAND COPLANAR WAVEGUIDE TO SLOTLINE TRANSITION HAVING A SLOT CAVITY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to the field of microwave integrated circuits, and more particularly to a coplanar waveguide to slotline transition employing a slot cavity to provide broadband power transfer.

One type of microwave integrated circuit device is a coplanar waveguide which generally consists of a thin conductor formed on a dielectric substrate and has two parallel coplanar ground conductors on opposite sides of the thin conductor. A basic example of a coplanar waveguide 10 is illustrated in FIG. 1 and is shown to include a center conductor 12 and ground planes 14 and 16 formed on the surface of a dielectric substrate 18. The ground planes 14 and 16 are electrically isolated from the center conductor by the slots 17 and 19. A radio frequency ("RF") signal is generally provided to the coplanar waveguide 10 at signal input 20 of the center conductor 12.

Another type of microwave integrated circuit device is a slotline. A basic example of a slotline 22, shown in FIG. 2, includes a slot or channel 24 typically etched in an electrically conductive layer 25 formed on a dielectric substrate 26 to form separate electrically conductive regions 28 and 30. In the application of the slotline 22, an RF signal is generally applied to the conductive regions 28 and 30. The RF signal generates an electric field which extends across the slot 24 and a magnetic field which is perpendicular to a plane defined by the conductive layers 28 and 30.

Japanese Patent No. JA 2-20101 discloses a mode converting circuit for RF coupling a slotline to a microstripline. Such circuit includes a slotline fabricated on one side of an insulating substrate and a microstripline formed on the opposite side of the insulating substrate. The slotline, having a length 1, is coaxially aligned and contiguous with the microstripline, where 1 represents the corresponding wavelength of the RF signal of interest. A circularly shaped slot cavity fabricated on the slotline side of the substrate (the opposite side of the substrate on which the microstripline is formed) is used to couple the energy from the slotline to the microstripline.

Japanese Patent No. 53-79356 discloses a microstripline conversion circuit which is similar to the circuit described in Japanese Patent No. JA 2-20101. This circuit includes a microstripline fabricated on one side of a substrate which is RF coupled to a circularly shaped slot cavity fabricated on the opposite side of the substrate.

The circuits described in the above referenced patents are not coplanar, that is, all of the elements of these circuits are not formed on the same side of the insulating substrate. Thus, these types of devices are generally not very practical for applications involving microwave integrated circuits which require the bottom side of the insulating substrate to be a ground plane. Thus, there is a need for a coplanar waveguide to slotline transition where all of the active elements are located on one side of the substrate.

Therefore, there is a need for a microwave integrated circuit which is capable of transferring RF power between ground isolated circuities.

DESCRIPTION OF THE DRAWINGS

In all figures identical reference labels refer to like elements, which may not be described in detail for all figures.

SUMMARY OF THE INVENTION

The present invention provides a microwave integrated circuit in the form of a broadband coplanar waveguide to slotline transition which is capable of transferring broadband RF energy between ground isolated circuits. The broadband coplanar waveguide to slotline transition comprises: 1) a dielectric substrate having a first planar surface; an electrically conductive layer formed on the first planar surface; 2) a coplanar waveguide including: a) a center conductor defined by a section of the electrically conductive layer bordered by first and second parallel channels formed in the electrically conductive layer so as to expose the dielectric substrate; b) a first ground plane defined by a section of the electrically conductive layer bordering the first channel; and c) a second ground plane defined by a section of the electrically conductive layer bordering the second channel; 3) a slot cavity formed in the electrically conductive layer so as to expose an area of the dielectric substrate, the slot cavity coextensive with the first channel and having a periphery such that the length of a line segment intersecting two points of the periphery and a centroid of the area is approximately $\lambda/4$; and 3) a slotline defined by a third channel formed in the electrically conductive layer which is coextensive with the second channel.

An important feature of the present invention is that it provides a uniplanar transition between a coplanar waveguide and a slotline wherein both the coplanar waveguide and slotline are formed, or printed on the same side of the substrate. Since the transition is uniplanar, no via-holes are needed for connections between the slotline and the coplanar waveguide. It is therefore much easier to fabricate and to integrate circuits embodying the present invention with other circuities. Another advantage of the invention is that it provides low insertion loss and excellent impedance matching over a bandwidth of which is expected to be greater than 5:1. By way of example, the present invention is expected to be integrated with wideband printed circuit antennas excited by a balanced arm feed printed on the same side of the substrate as the transition.

DESCRIPTION OF THE PREFERRED EMBODIMENT

Figure 1:
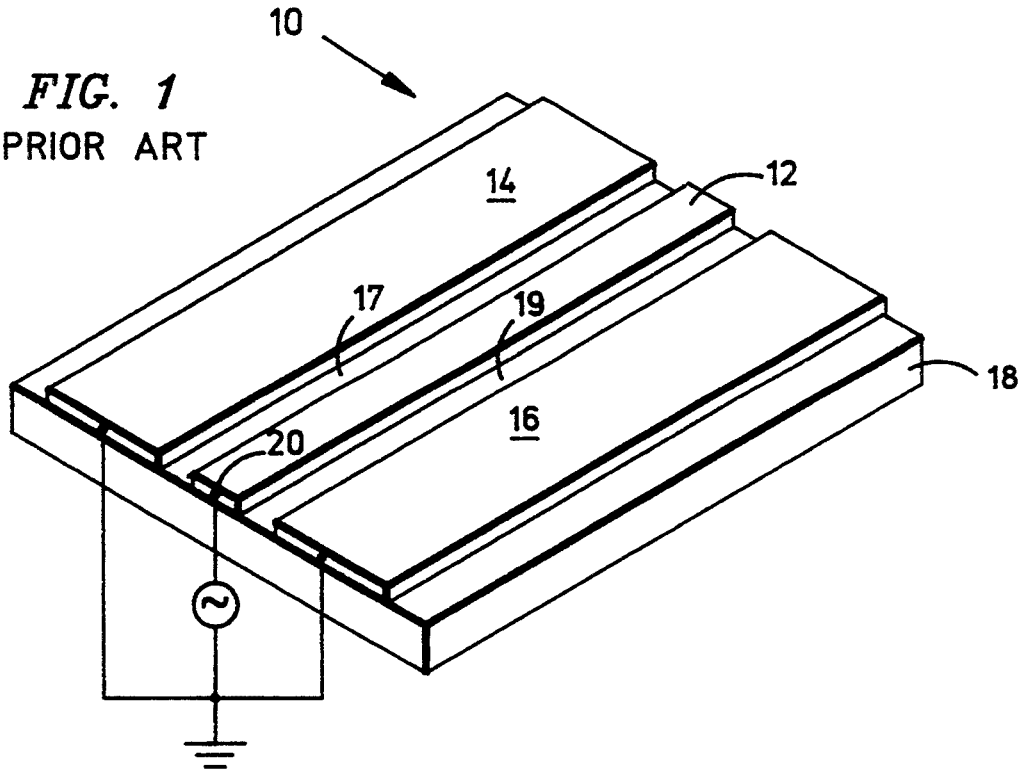
FIG. 1 PRIOR ART
FIG. 1 illustrates an example of a prior art coplanar waveguide.
Figure 2:
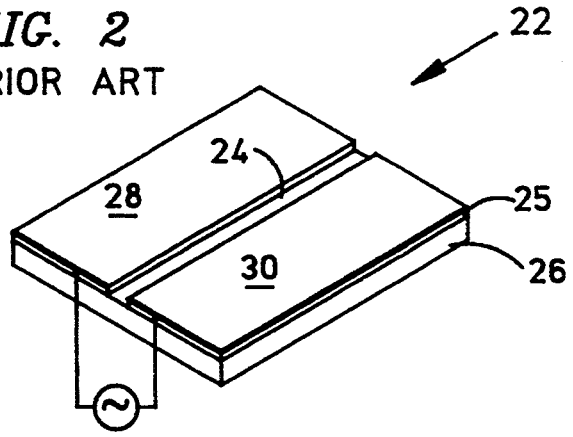
FIG. 2 PRIOR ART
FIG. 2 illustrates an example of a prior art slotline.
Figure 3:
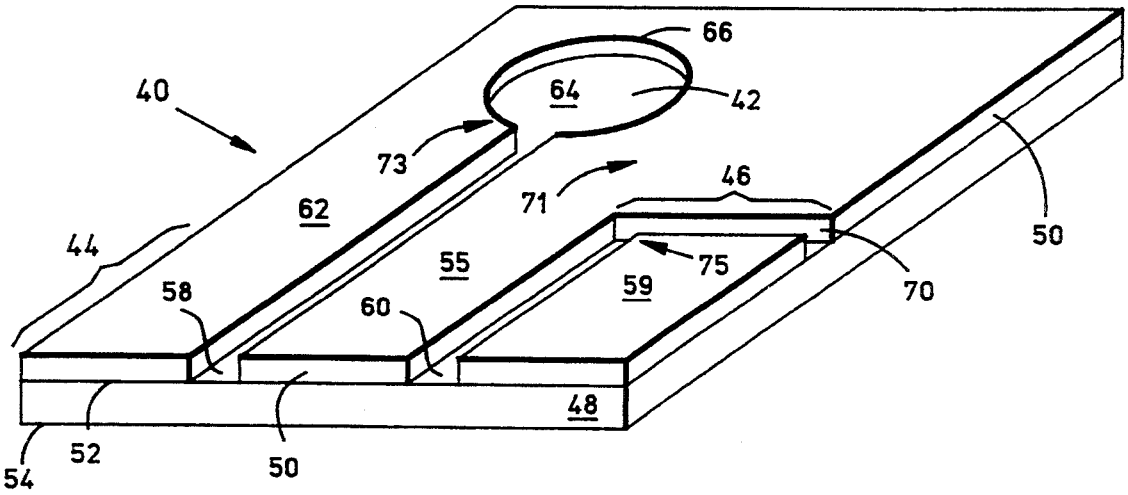
FIG. 3 illustrates a perspective three-quarter view of a broadband coplanar waveguide to slotline transition embodying various features of the present invention.

Referring to FIG. 3, the present invention provides a broadband coplanar waveguide to slotline transition 40 (for convenience, also referred to as a "transition") for transferring radio frequency ("RF") energy having a wavelength, λ, between coplanar waveguide and slotline circuits. The transition 40 comprises a resonant slot cavity 42 which provides essentially complete power transfer between a coplanar waveguide 44 and a slotline 46. The coplanar waveguide 44, slotline 46, and slot cavity 42 preferably are fabricated from a single substrate 48 having opposed first and second planar surfaces 52 and 54. By way of example, the substrate 48 may be formed of an electrically insulating, or dielectric material, such as plastic, ceramics, quartz, alumina. The substrate may also be formed of semiconductors such as silicon or gallium arsenide. An electrically conductive layer 50 is formed on one of the planar surfaces 52 or 54, and may, by way of example, consist of materials selected from the group of copper, aluminum, electrically conducting polymers, and superconductive metals. A superconductive metal is a metal which has no electrical resistance below some critical temperature.

The coplanar waveguide 44 includes a section of the substrate 48, and a center conductor 55 defined as a portion of the conductive layer 50 which is shaped as a rectangular prism by preferably etching away sections of the conductive layer 50 to form two parallel channels 58 and 60 which expose the planar surface 52 of the substrate 48. The coplanar waveguide 44 further includes a first ground plane 62 defined by the section of the conductive layer 50 which is bordered by the channel 58 and a second ground plane 59 defined by the section of the conductive 50 layer which is bordered by the channel 60.

Figure 4:
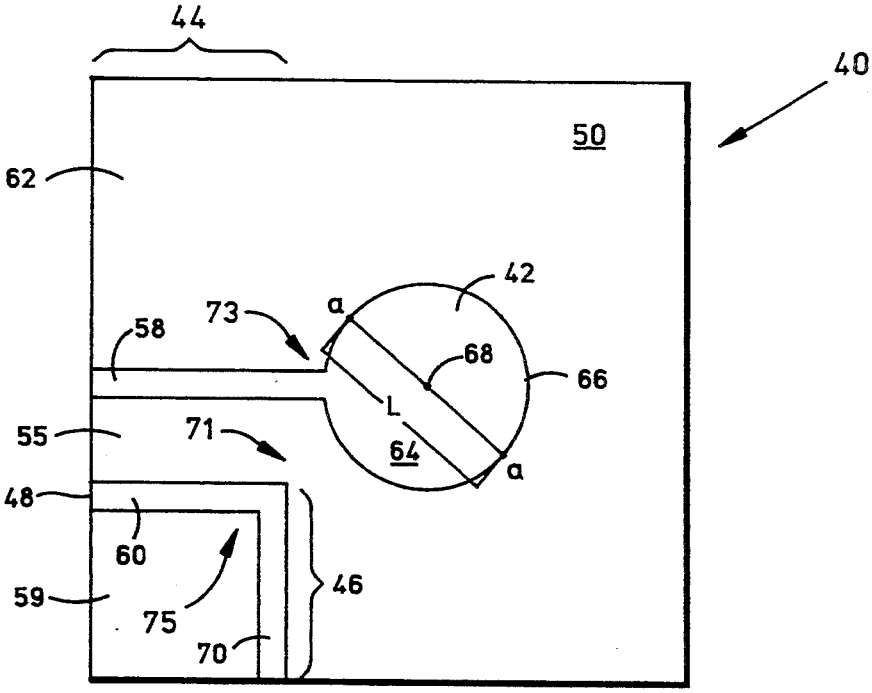
FIG. 4 illustrates a plan view of the broadband coplanar waveguide to slotline transition of FIG. 3.
Figure 8:
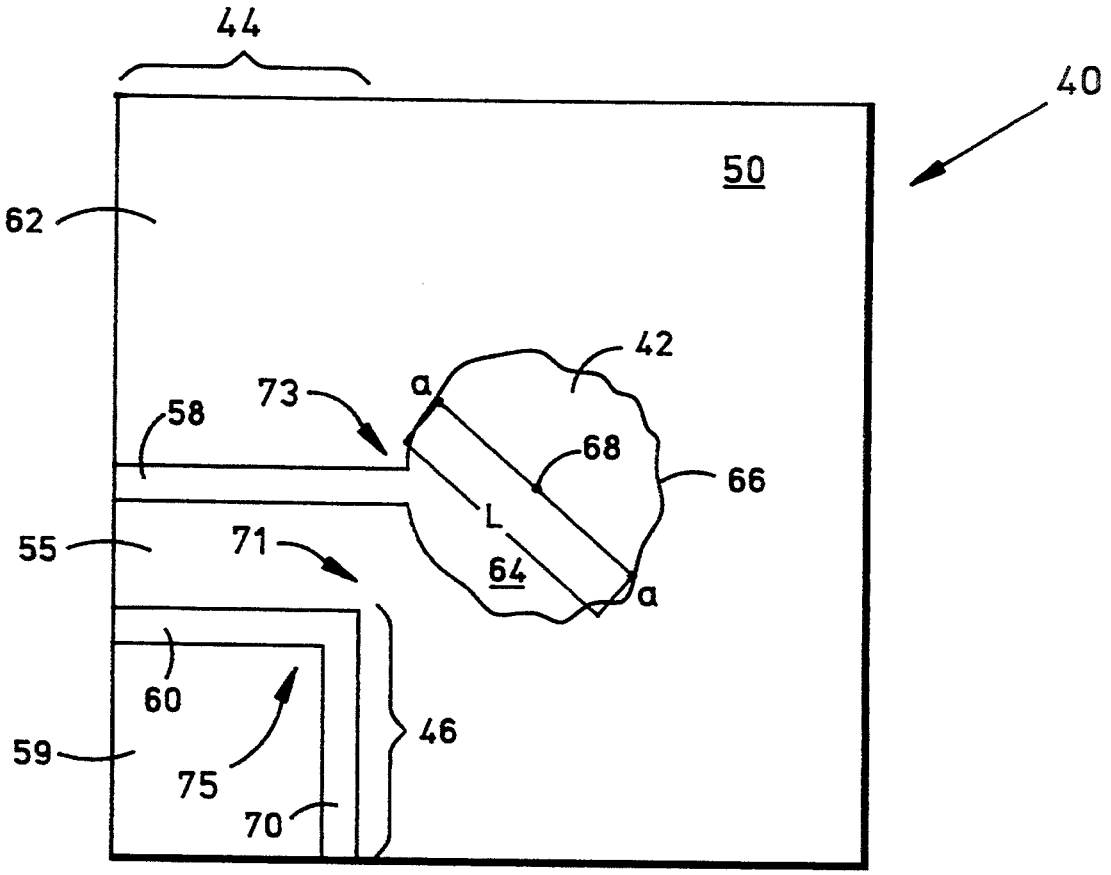
FIG. 8 illustrates a plan view of the broadband coplanar waveguide to slotline transition of FIG. 3 having an irregularly shaped slot cavity.

Referring to FIG. 4, the slot cavity 42 is preferably formed by etching out a region of the conductive layer 50 which is contiguous with the channel 58 at the output terminal 73 of the coplanar waveguide 44 so as to expose an area 64 of the substrate 48 preferably in the shape of circle, as shown in FIG. 3. The diameter of the exposed area 64 is substantially equal to $\lambda/4$, where $\lambda$ represents the wavelength of the RF energy to be transferred by the transition 40. More generally, as shown in FIG. 4, the area 64 need not be circularly shaped, but may be irregularly shaped. More generally, as shown in FIG. 8, the shape of the exposed area 64, and hence, the slot cavity 42 may be of any shape provided that the length, L, of a line segment, as for example, line segment a—a, which intersects any two points of the periphery 66 of the slot cavity 42, and the centroid 68 of the area 64, is approximately $\lambda/4$, and more preferably, where the length L generally satisfies the relation: $0.75\ L \leqq \lambda/4 \leqq 1.30\ L$. Thus, for example, the area 64 may be shaped as an ellipsoid, polygon, area defined by a combination of curved and/or segmented lines, or any other shape which satisfies the above constraints for the value of L.

Referring still to FIG. 4, the coplanar waveguide 44 also includes a coplanar terminal 73 which is the section of the first ground plane 62 in the vicinity where the channel 58 intersects the cavity 42.

Referring still to FIG. 4, the slotline 46 is defined by a channel 70 which intersects the channel 60 and also thereby, defines a slotline terminal 71 of the coplanar waveguide 44. The terminal 71 is the region of the center conductor 55 in proximity to the intersection of the channels 60 and 70. Although the intersection of the channels 60 and 70 is shown to be at a right angle, it is to be understood that the channel 70 may intersect the channel 60 at an oblique angle. Furthermore, the channel 70 need not necessarily be straight, but may also be curved or even sinuous.

Figure 5:
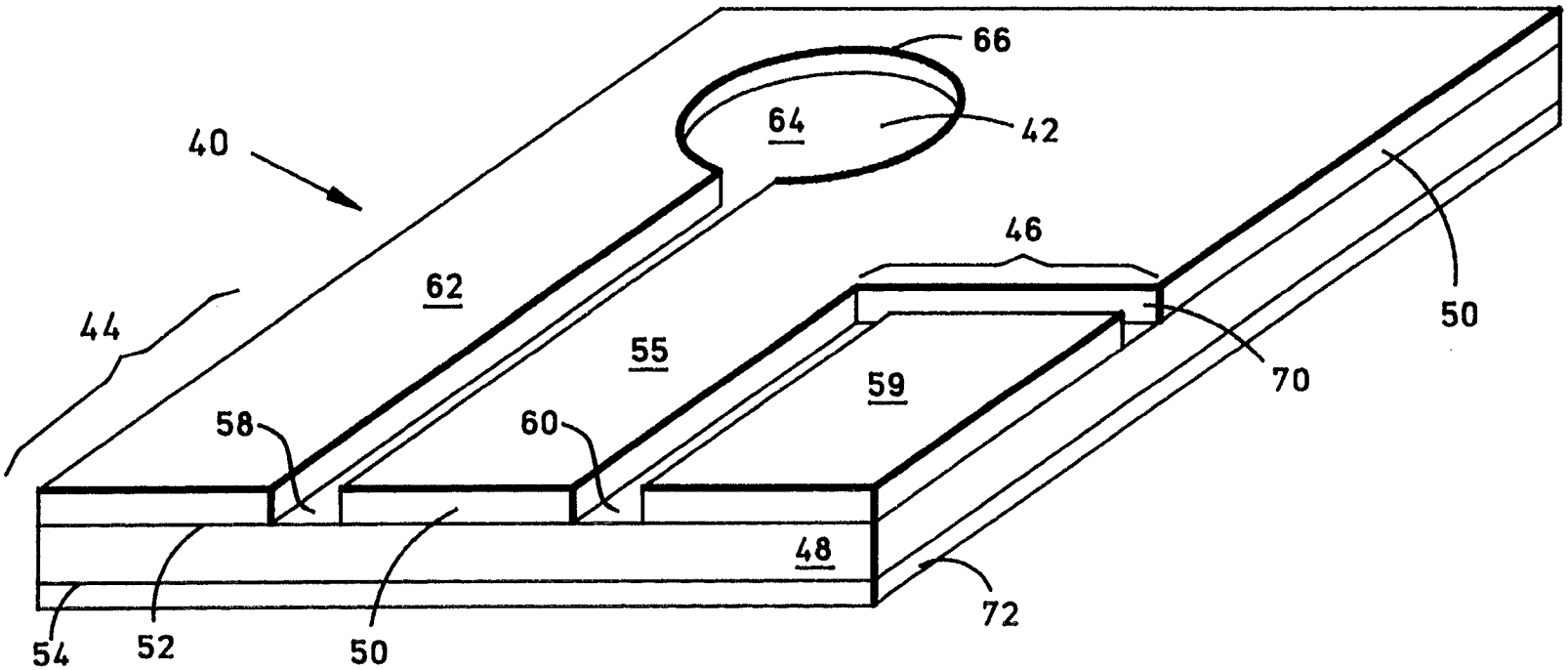
FIG. 5 illustrates a perspective three-quarter view of a broadband coplanar waveguide to slotline transition embodying various features of the present invention which includes a second electrically conductive layer as a ground plane.

In another aspect of the invention, as shown in FIG. 5, an electrically conducting layer 72 may be formed on the second planar surface 54 of the substrate 48 which establishes electromagnetic boundary conditions which serve as a "ground" plane.

Figure 6:
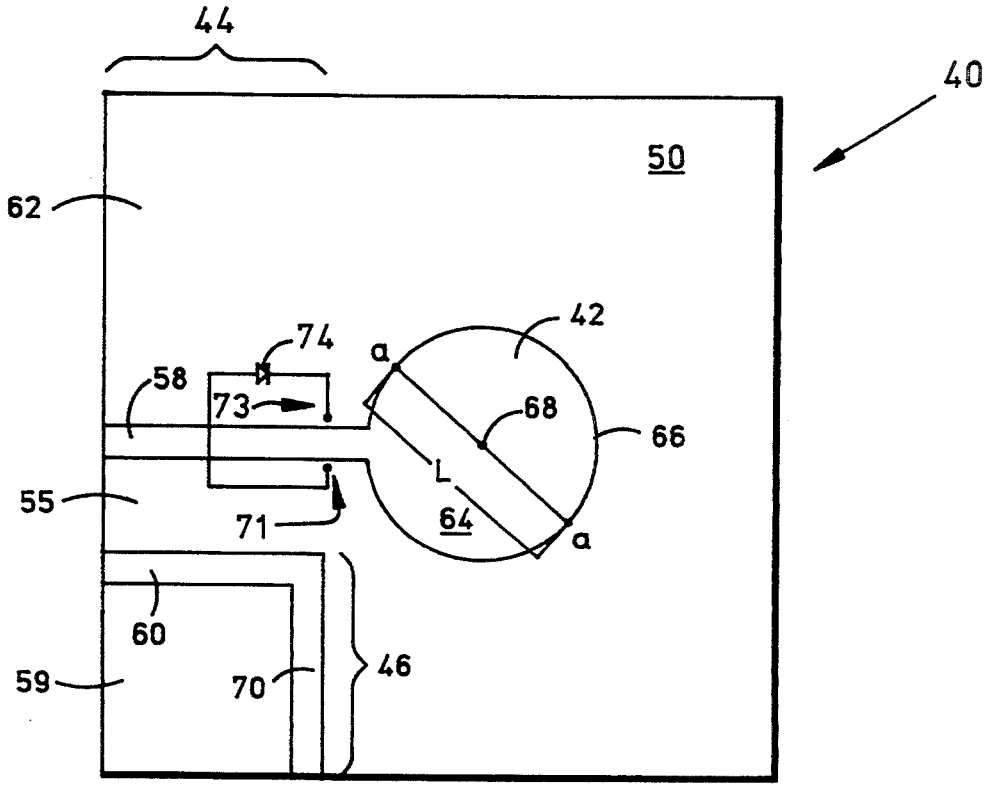
FIG. 6 illustrates a plan view of the broadband coplanar waveguide to slotline transition of FIG. 3 which further includes a semiconducting device connected across a channel.
Figure 7:
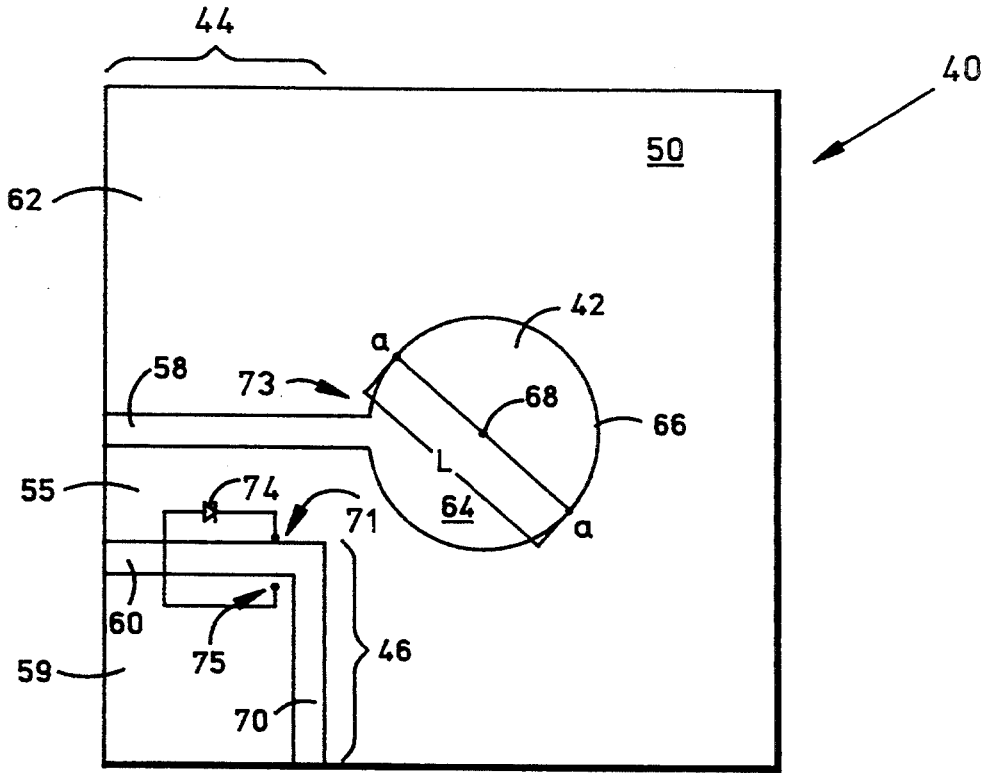
FIG. 7 illustrates a plan view of the broadband coplanar waveguide to slotline transition of FIG. 3 which further includes a semiconducting device connected across another channel.

Another aspect of the transition 40, as shown in FIG. 6 may include a semiconductor device 74 connected across opposite sides of the channel 58. By way of example, the semiconducting device 74 may be a photodiode, photoresistor, or photoconductor, having an impedance related to the intensity and wavelength of optical energy falling incident upon the semiconductor device. For example, a photoconductor has an electrical impedance which decreases upon exposure to optical energy of increasing intensity. Alternatively, as shown in FIG. 7, the semiconductor device 74 may be connected across opposite sides of the channel 60 at the terminal 71 and a second ground plane terminal 75 defined by the section of the ground plane 59 bounded by the intersection of the channels 60 and 70.

Obviously, many modifications and variations of the present invention are possible in light of the above teachings. It is therefore to be understood that within the scope of the appended claims, the invention may be practiced otherwise than as specifically described.

We claim:

1. A broadband transition from coplanar waveguide to slotline for transferring radio frequency energy having a wavelength, λ, comprising:

a dielectric substrate having a first planar surface, a coplanar waveguide region formed on said first planar surface, said coplanar waveguide region including a first ground plane, a second ground plane, and a center conductor, said center conductor formed between said first ground plane and said second ground plane in said coplanar waveguide region, said center conductor separated from said first ground plane by a first channel in said coplanar waveguide region, and said center conductor separated from said second ground plane by a second channel parallel to said first channel, said first ground plane being DC electrically isolated from said second ground plane;

a slotline region formed on said first planar surface and including said first ground plane, said second ground plane, and a third channel extending from said second channel and formed between said first ground plane and said second ground plane in said slotline region;

a slot cavity defined by an exposed region of said first planar surface; and a transition region between said coplanar waveguide region and said slotline region wherein said center conductor extends from said coplanar waveguide region to connect with said first ground plane in said transition region, said slot cavity extends to connect with said first channel in said transition region, and said second channel extends to connect with said third channel in said transition region.

2. The broadband transition of claim 1 wherein said slot cavity is characterized by a periphery and centroid such that a distance L between any two first and second points on said periphery that are collinear with said centroid satisfies the relation $0.75\ L \leqq \lambda/4 \geqq 1.30\ L$.

3. The broadband transition of claim 2 wherein said slot cavity is elliptically shaped.

4. The broadband transition of claim 2 wherein said slot cavity has the shape of a polygon.

5. The broadband transition of claim 1 wherein said dielectric substrate includes a second planar surface opposed to said first planar surface and said broadband transition further includes a conducting layer disposed on said second planar surface.

6. The broadband transition of claim 5 wherein said slot cavity is characterized by a periphery and centroid such that a distance L between any two first and second points on said periphery that are collinear with said centroid satisfies the relation $0.75\ L \leqq \lambda/4 \geqq 1.30\ L$.

7. The broadband transition of claim 6 wherein said slot cavity is elliptically shaped.

8. The broadband transition of claim 6 wherein said slot cavity has the shape of a polygon.

9. A broadband transition from coplanar waveguide to slotline for transferring radio frequency energy having a wavelength, λ, comprising:

a dielectric substrate having a first planar surface;

a coplanar waveguide region formed on said first planar surface, said coplanar waveguide region including a first ground plane, a second ground plane, and a center conductor, said center conductor formed between said first ground plane and said second ground plane in said coplanar waveguide region, said center conductor separated from said first ground plane by a first channel in said coplanar waveguide region, and said center conductor separated from said second ground plane by a second channel parallel to said first channel, said first ground plane being DC electrically isolated from said second ground plane;

a slotline region formed on said first planar surface and including said first ground plane, said second ground plane, and a third channel extending from said second channel and formed between said first ground plane and said second ground plane in said slotline region;

a slot cavity defined by an exposed region of said first planar surface;

a transition region between said coplanar waveguide region and said slotline region wherein said center conductor extends from said coplanar waveguide region to connect with said first ground plane in said transition region, said slot cavity extends to connect with said first channel in said transition region, and said second channel extends to connect with said third channel in said transition region; and a semiconductor device electrically connected between said first ground plane and said center conductor.

10. The broadband transition of claim 9 wherein said slot cavity is characterized by a periphery and centroid such that a distance L between any two first and second points on said periphery that are collinear with said centroid satisfies the relation $0.75L \leq \gamma 4/ \geq 1.30L$.

11. The broadband transition of claim 10 wherein said slot cavity is elliptically shaped.

12. The broadband transition of claim 10 wherein said slot cavity has the shape of a polygon.

13. The broadband transition of claim 9 wherein said dielectric substrate includes a second planar surface opposed to said first planar surface and said broadband transition further includes a conducting layer disposed on said second planar surface.

14. The broadband transition of claim 9 wherein said semiconductor device is a photodiode.

15. The broadband transition of claim 9 wherein said semiconductor device is a photoconductor.

16. A broadband transition from coplanar waveguide to slotline for transferring radio frequency energy having a wavelength, λ, comprising:

a dielectric substrate having first and second opposed planar surfaces;

an electrically conductive layer formed on said second surface;

a coplanar waveguide region formed on said first planar surface, said coplanar waveguide region including a first ground plane, a second ground plane, and a center conductor, said center conductor formed between said first ground plane and said second ground plane in said coplanar waveguide region, said center conductor separated from said first ground plane by a first channel in said coplanar waveguide region, and said center conductor separated from said second ground plane by a second channel parallel to said first channel, said first ground plane being DC electrically isolated from said second ground plane;

a slotline region formed on said first planar surface and including said first ground plane, said second ground plane, and a third channel extending from said second channel and formed between said first ground plane and said second ground plane in said slotline region;

a slot cavity defined by an exposed region of said first planar surface; and a transition region between said coplanar waveguide region and said slotline region wherein said center conductor extends from said coplanar waveguide region to connect with said first ground plane in said transition region, said slot cavity extends to connect with said first channel in said transition region, and said second channel extends to connect with said third channel in said transition region.

17. The broadband transition of claim 16 wherein said substrate is a semiconductor material.

18. The broadband transition of claim 16 wherein said first and second ground planes and said center conductor each includes a superconducting material.

19. A broadband transition from coplanar waveguide to slotline for transferring radio frequency energy having a wavelength, λ, comprising:

a dielectric substrate having a first planar surface;

a coplanar waveguide region formed on said first planar surface, said coplanar waveguide region including a first ground plane, a second ground plane, and a center conductor, said center conductor formed between said first ground plane and said second ground plane in said coplanar waveguide region, said center conductor separated from said first ground plane by a first channel in said coplanar waveguide region, and said center conductor separated from said second ground plane by a second channel parallel to said first channel, said first ground plane being DC electrically isolated from said second ground plane;

a slotline region formed on said first planar surface and including said first ground plane, said second ground plane, and a third channel extending from said second channel and formed between said first ground plane and said second ground plane in said slotline region;

a slot cavity defined by an exposed region of said first planar surface;

a transition region between said coplanar waveguide region and said slotline region wherein said center conductor extends from said coplanar waveguide region to connect with said first ground plane in said transition region, said slot cavity extends to connect with said first channel in said transition region, and said second channel extends to connect with said third channel in said transition region; and a semiconductor device electrically connected between said second ground plane and said center conductor.

20. The broadband transition of claim 19 wherein said semiconductor device is a photodiode.

21. The broadband transition of claim 19 wherein said semiconductor device is a photoconductor.

* * * * *